US007173569B1

(12) United States Patent
Smith

(10) Patent No.: US 7,173,569 B1
(45) Date of Patent: Feb. 6, 2007

(54) GPS SPEEDOMETER AND COMMUNICATION DEVICE FOR BOATS

(76) Inventor: Michael P. Smith, 46-280 Papago Cir., Indian Wells, CA (US) 92210

( * ) Notice: Subject to any disclaimer, the term of this patent is extended or adjusted under 35 U.S.C. 154(b) by 0 days.

(21) Appl. No.: 11/181,114

(22) Filed: Jul. 14, 2005

(51) Int. Cl.
*H01Q 1/34* (2006.01)

(52) U.S. Cl. ..... 343/709; 343/713

(58) Field of Classification Search ..... 343/709, 343/710, 711, 712, 713, 878, 906
See application file for complete search history.

(56) References Cited

U.S. PATENT DOCUMENTS

| | | | | |
|---|---|---|---|---|
| 3,816,837 | A | 6/1974 | Smith | |
| 3,896,448 | A | 7/1975 | Killen et al. | |
| 4,758,166 | A | 7/1988 | Bonnett et al. | |
| 5,402,134 | A | 3/1995 | Miller et al. | |
| 5,634,209 | A | 5/1997 | Prudhomme et al. | |
| 5,649,316 | A | 7/1997 | Prudhomme et al. | |
| 5,682,168 | A | 10/1997 | James et al. | |
| 6,011,518 | A | 1/2000 | Yamagishi et al. | |
| 6,208,305 | B1 | 3/2001 | King | |
| 6,351,242 | B1 * | 2/2002 | Hesker | 343/713 |
| 6,380,901 | B1 * | 4/2002 | Tessier | 343/713 |
| 6,678,589 | B2 | 1/2004 | Robertson et al. | |
| 6,788,255 | B2 * | 9/2004 | Sakamoto et al. | 343/700 MS |
| 6,812,900 | B2 * | 11/2004 | Ghabra et al. | 343/713 |

* cited by examiner

*Primary Examiner*—Hoanganh Le
(74) *Attorney, Agent, or Firm*—Dale J. Ream

(57) ABSTRACT

A speedometer and communication device for boats includes a hand-held GPS unit, mounting member and antenna ring. The mounting member has a flange that extends and secures the mounting member to a cavity located in the dashboard of the boat. The mounting member may further have a power plug to supply power and mounting posts to secure the hand-held GPS unit. The antenna ring contains a receiver for receiving GPS signals and a transmitter for re-sending GPS signals. The hand-held GPS unit receives, calculates, and displays data relating to speed, location, time and includes user-selectable buttons for contacting emergency services.

20 Claims, 7 Drawing Sheets

GPS SPEEDOMETER AND COMMUNICATION DEVICE FOR BOATS

BACKGROUND AND SUMMARY OF THE INVENTION

This invention relates generally to GPS speedometers and, more particularly, to a multi-function GPS speedometer for boats that is removable from a base mounting and functional as a communication and emergency notification device.

GPS speedometers have proven to provide highly accurate speed readings to within one-tenth of a mile per hour. Many small GPS devices have small built-in antennas and the GPS devices can lose reception in rough conditions. Without satellite reception, the GPS devices lose their ability to calculate speed and position and cannot function to call for emergency services.

Often, additional external antennae are used in conjunction with GPS devices to give the GPS devices the ability to stay in communication with the GPS satellites. However, these external antennas can be bulky, aesthetically unappealing, or require a physical connection to the GPS device. This can detract from the advantages of having additional external antennae.

Further, the external antennae can become damaged by weather conditions, other boats, or even wildlife. If the external antennae cannot function, the GPS devices lose their functionality. This can be particularly worrisome if the boat is sinking, out of fuel, a passenger falls off the boat, or a medical emergency occurs on the boat. The boat operator would not be able to use the GPS device to aid in solving any of these problems. These shortcomings could be overcome by implementing a GPS speedometer with desirable safety and user-convenience features coupled into a reliable simple to install internal antenna system Although assumably effective for their intended purposes, the prior patent proposals do not provide a GPS speedometer for a boat having all of the advantages of the present invention. U.S. Pat. No. 6,678,589, issued to Robertson, discloses the use of a GPS system for boats. However, the device disclosed in the '589 patent is for a boat positioning and anchoring system and fails to utilize the extremely practical safety features of GPS devices and does not address the unique and dangerous situations that can arise on a nautical vessel.

Further, the prior art references do not adequately address the unique issues faced by boaters. Most, if not all, of the patents relate specifically to cars and do not track or suggest the unique safety issues experienced by watercraft. U.S. Pat. No. 5,649,316, issued to Prudhomme, discloses an external antenna for a cellular phone system located in a car. Moreover, U.S. Pat. No. 3,896,448, issued to Killen, discloses a radio antenna in the dashboard of a car for use by an AM/FM receiver in the dashboard of the car. Finally, U.S. Pat. No. 6,208,305, issued to King, discloses an antenna in the dashboard of a car to be used in conjunction with a remote entry or keyless start system.

None of the devices in these references relate directly to a device that has an antenna in a mounting member which removably secures a control unit to be used on a boat. Therefore it would be desirable to have a GPS speedometer and communication device that has increased satellite reception, is mobile, can be removably mounted on the boat, and allows a boater to be able to contact emergency services at a moment's notice.

The present invention overcomes the problems that can be associated with GPS devices used on boats. The present invention provides a mounting member to securely hold the control unit. Further, the present invention provides an antenna in the mounting member that increases the receptive range of the GPS control unit and is structurally protected from external damage.

SUMMARY OF THE INVENTION

Accordingly, a speedometer and communication device according to the present invention generally includes a mounting member, an antenna ring, and a hand-held GPS speedometer unit removably mounted to the mounting member.

The dashboard of the boat defines a mounting cavity. This typically would be the cavity where the boat's old speedometer was located. The circularly shaped mounting member for the present invention has a flange, which has a configuration complementary to the mounting cavity in the boat dashboard. The mounting member flange is inserted into the mounting cavity and mounted on the dashboard. This can be accomplished with a fastener such as a ring nut with a configuration complementary to the configuration of the flange. Finally, the bottom of the mounting member is open.

An antenna ring is positioned in the bottom of the mounting member. A receiver and a transmitter are included in the antenna ring. The receiver accepts GPS signals while the transmitter amplifies and re-sends GPS signals.

The control unit is releasably coupled to the mounting member. Preferably, the control unit is a hand-held GPS unit. The hand-held GPS unit has the capabilities of using the GPS satellites to determine a position of the unit. The GPS unit may be equipped to instantly contact a telematics service such as OnStar when there is an emergency. The GPS unit may also use a tracking service, such as Trackology, to track time and location of the GPS unit.

Therefore, a general object of this invention is to provide a device that is mountable to a boat dashboard and that displays GPS speedometer data.

Another object of this invention is to provide a device, as aforesaid, having a selectively releasable and portable hand-held unit.

Still another object of this invention is to provide a device, as aforesaid, that has increased reception and transmission ranges.

A further object of this invention is to provide a device, as aforesaid, that further increases the range of the GPS unit with the use of antennae posts that also protect the GPS unit when coupled with the mounting member.

Yet another object of this invention is to provide a device, as aforesaid, that allows a user to instantly contact emergency services when needed.

Another object of the invention is to provide a device, as aforesaid, that is securely attached but can be easily removed.

Still another object of this invention is to provide a device, as aforesaid, that provides power to the GPS unit from the boat's power source.

Another object of this invention is to provide a device with a self productive internal antenna that has all the benefits of an external antenna.

Yet another object of this invention is to provide a device, as aforesaid, that is made of buoyant material.

A further object of this invention is to provide a device, as aforesaid, that is relatively portable, allowing a user to move throughout the boat, but still retain the other benefits of the present invention such as increased transmission and reception range.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A GPS speedometer and communication device according to the present invention will now be described in detail with reference to FIGS. 1 through 7*b* of the accompanying drawings. More particularly, a GPS speedometer and communication device for boats 10 includes a control unit 12, a mounting member 14, and an antenna ring 16 (FIGS. 1 and 2).

Figure 3A:
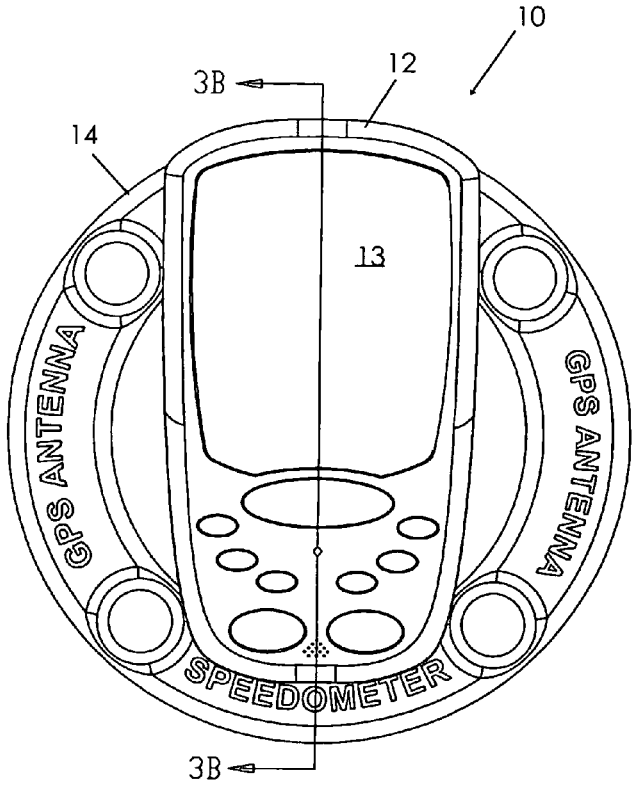
FIG. 3A is a front view of the GPS speedometer and communication device as in FIG. 1.
Figure 3B:
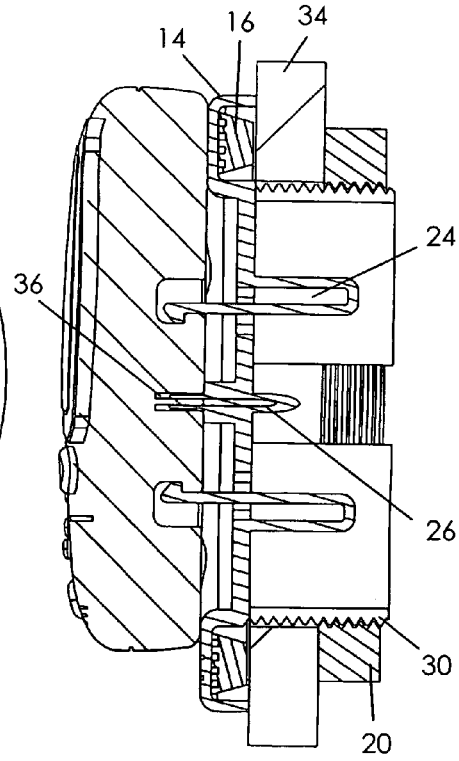
FIG. 3B is a sectional view taken along line 3B—3B of FIG. 3A.

The mounting member 14 includes a mounting member flange 30 that extends into a mounting cavity defined by the boat dashboard 34 and may be mounted therein with a fastener 20 such as a ring nut or the like (FIG. 3). In the preferred embodiment, the fastener 20 has a threaded inner configuration complementary to a configuration of the mounting member flange 30 such that the fastener 20 may be threadably coupled to the mounting member flange 14 when the mounting member flange 30 is extended through the boat dashboard 34, whereby to hold the entire mounting member 14 in place on the boat dashboard 34.

Figure 1:
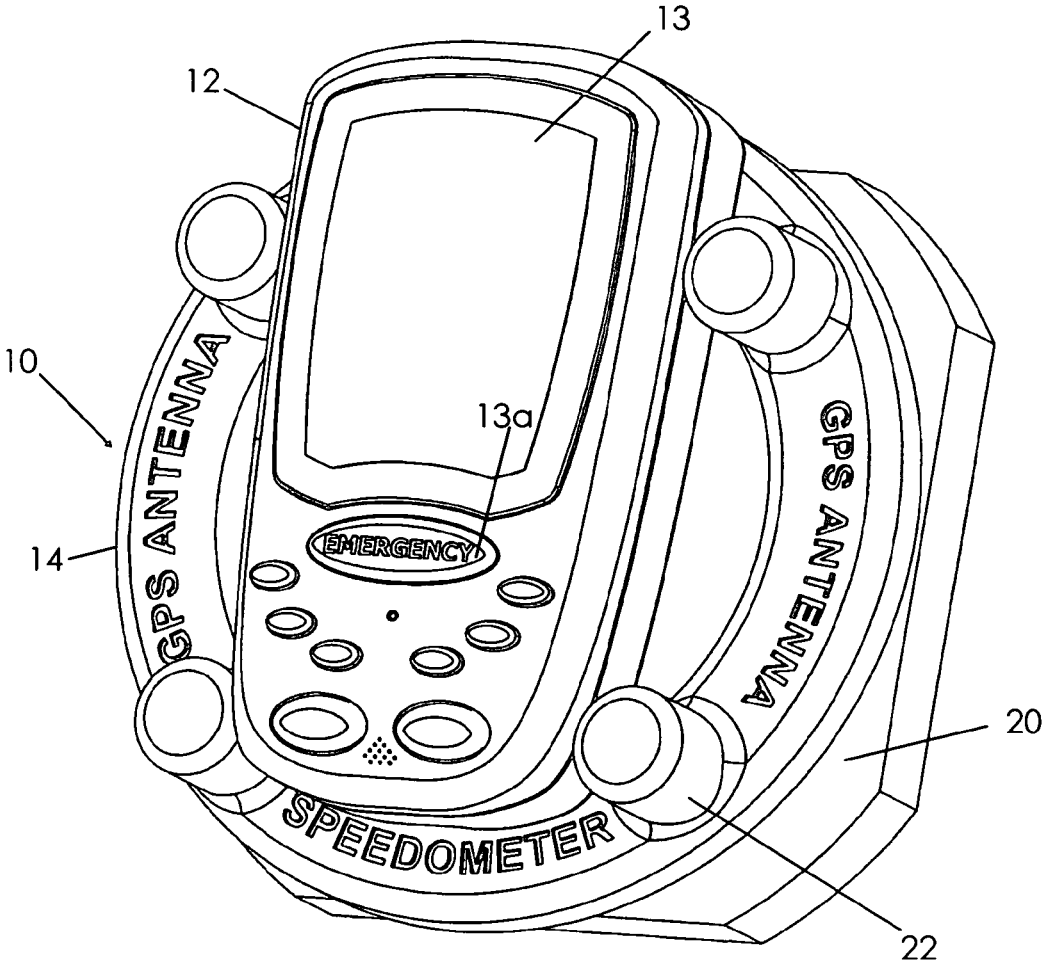
FIG. 1 is a front perspective view of a speedometer and communication device according to the present invention.
Figure 2:
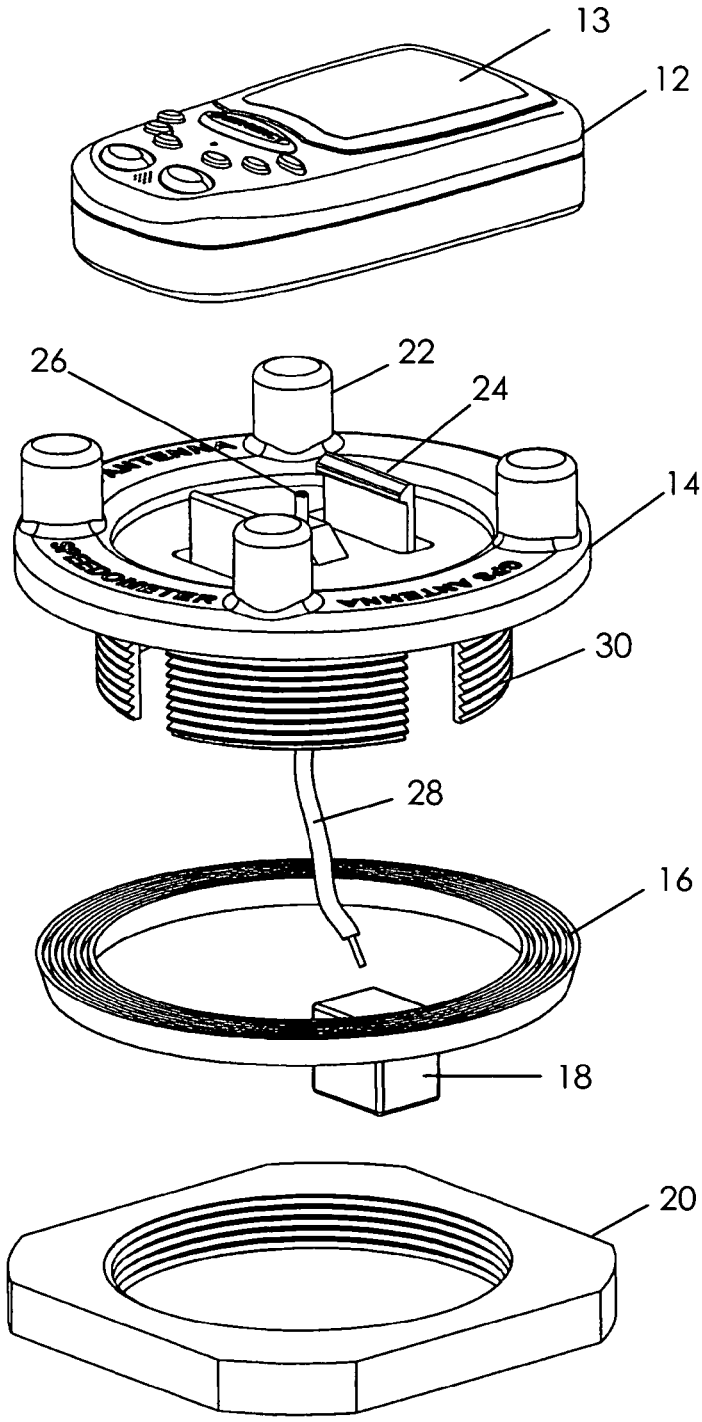
FIG. 2 is an exploded view of the present invention.

The control unit 12 is removably or releasably mounted to the mounting member 14 (FIGS. 1 and 2). The mounting member 14 includes a pair of mounting posts 24 extending from a front surface thereof. The mounting posts 24 releasably receive and engage corresponding mounting slots 32 on a rear surface of the control unit 12 in a snap-fit relationship.

The control unit 12 may be a radio, a single function GPS unit, a multiple function GPS unit, or the like. The control unit 12 includes a housing that is preferably constructed using buoyant materials so that the control unit 12 will float if the control unit 12 errantly ends up in water, like a river, lake, or ocean. The control unit 12 includes GPS circuitry capable of receiveing GPS data, and then calculating and displaying accurate speed data on a display unit 13. More particularly, the control unit 12 includes a receiver 12*a* for receiving GPS signals from respective GPS satellites 38 or re-transmitted GPS signals from an antenna ring as will be described below, and a transmitter 12*b* for re-transmitting those signals such as to a GPS tracking service 42 (FIG. 6) as will be described in more detail later. The control unit 12 is also able to contact emergency services when needed by pressing the emergency button 13*a* (FIG. 1).

Figure 7A:
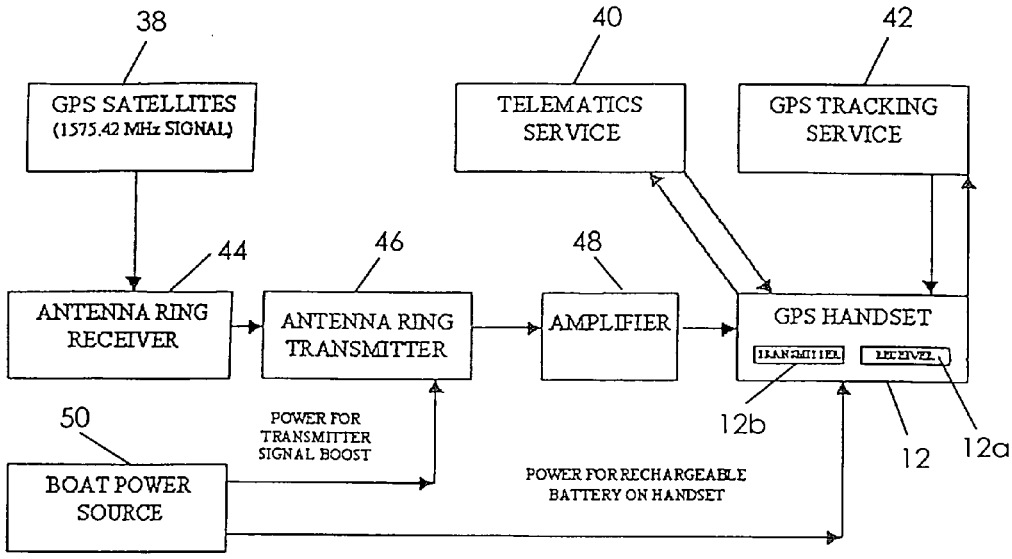
FIG. 7*a* is a block diagram showing a GPS unit docked in the mounting member.
Figure 7B:
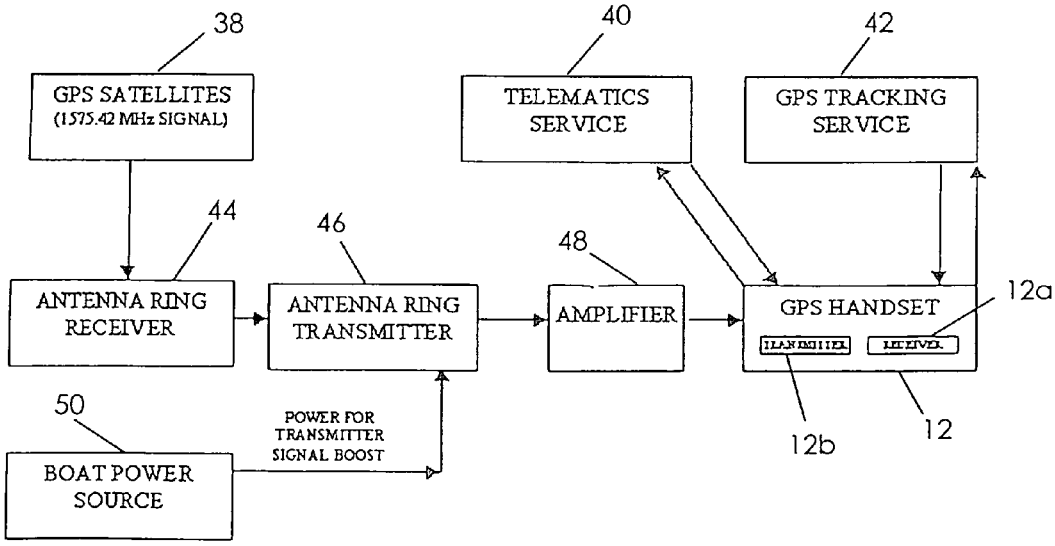
FIG. 7*b* is a block diagram showing a GPS unit undocked but within two meters of the remaining elements of the present invention.

The GPS speedometer and communication device for boats 10 includes an antenna ring 16 positioned inside of the mounting member 14 (FIG. 2). The antenna ring 16 includes an antenna ring receiver 44 for receiving GPS signals, an antenna ring transmitter 46 for re-transmitting received GPS signals, and an antenna ring amplifier for amplifying the GPS signals as it re-transmits them (FIGS. 7*a* and 7*b*). In the preferred embodiment, an electronics box 18 is in communication with the antenna ring 16 and houses these antenna ring electronics.

The GPS speedometer and communication device for boats 10 further includes at least one auxiliary antenna located in antenna posts 22 on the front surface of the mounting member 14 (FIG. 1). Each additional antenna is in electrical communication with the antenna ring 16 for enhancing signal reception thereof. Each additional antenna may be a quad helix antenna, a mircostrip patch, or other suitable antenna. Additionally, the antenna posts 22 protect the control unit 12 from damage when it is removably mounted on the mounting member 14.

Figure 4:
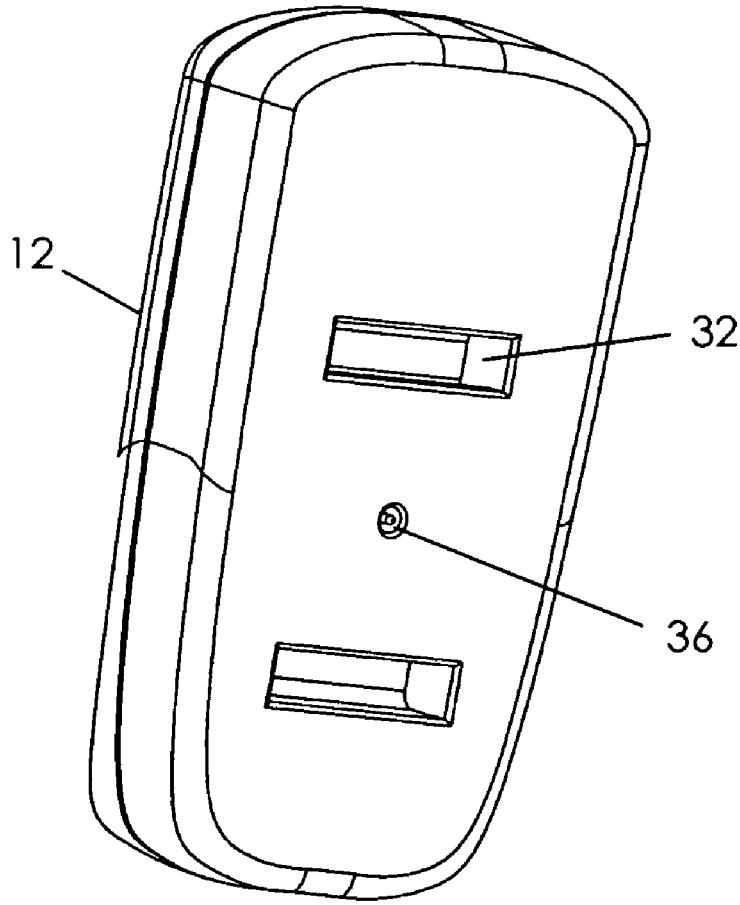
FIG. 4 is a rear perspective view of the control unit.
Figure 5:
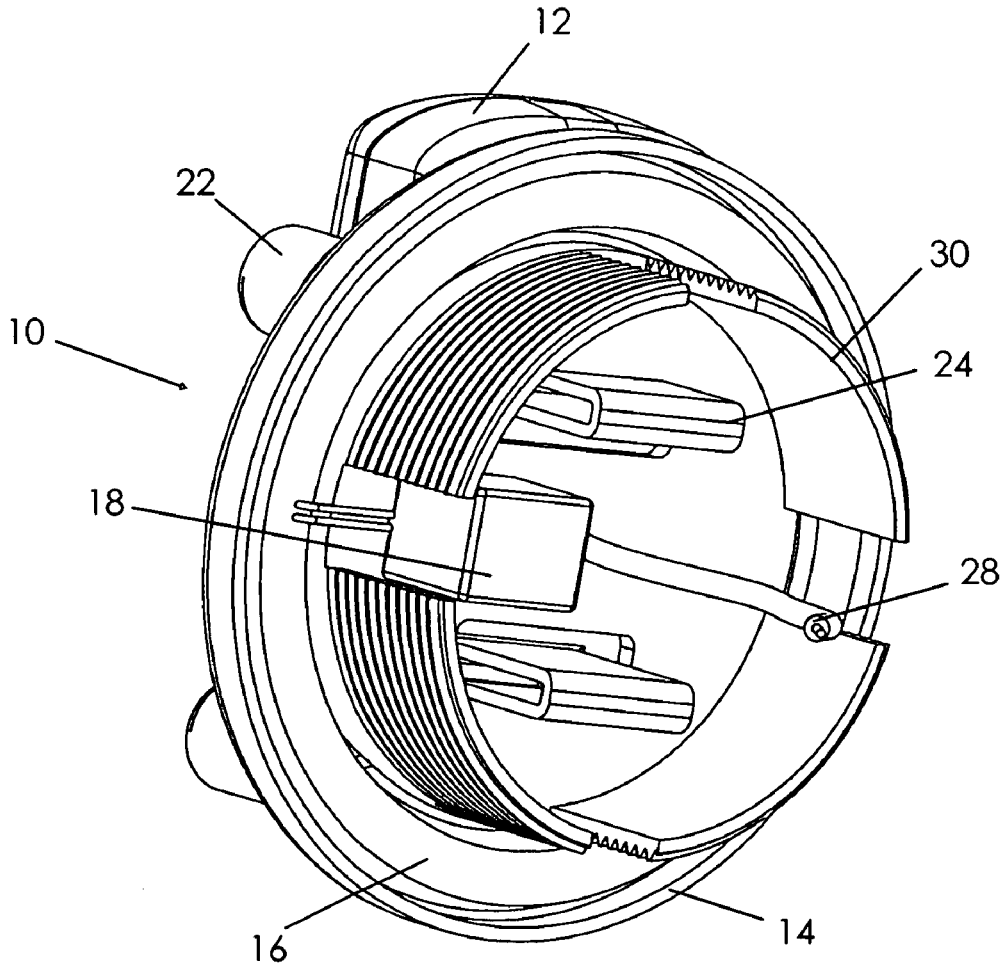
FIG. 5 is a rear perspective view of the speedometer and communication device.

The mounting member 14 includes a power jack 28 for connecting the control unit 12 to a power supply (FIGS. 2 and 5), such as the boat's battery or auxiliary power source. The power jack 28 includes a power plug 26 at one end for electrical connection to the control unit 12. The power plug 26 communicates with a complementary GPS unit power receptacle 36 for allowing the control unit 12 to either recharge its battery, or run directly on the boat's power source (FIG. 4).

Figure 6:
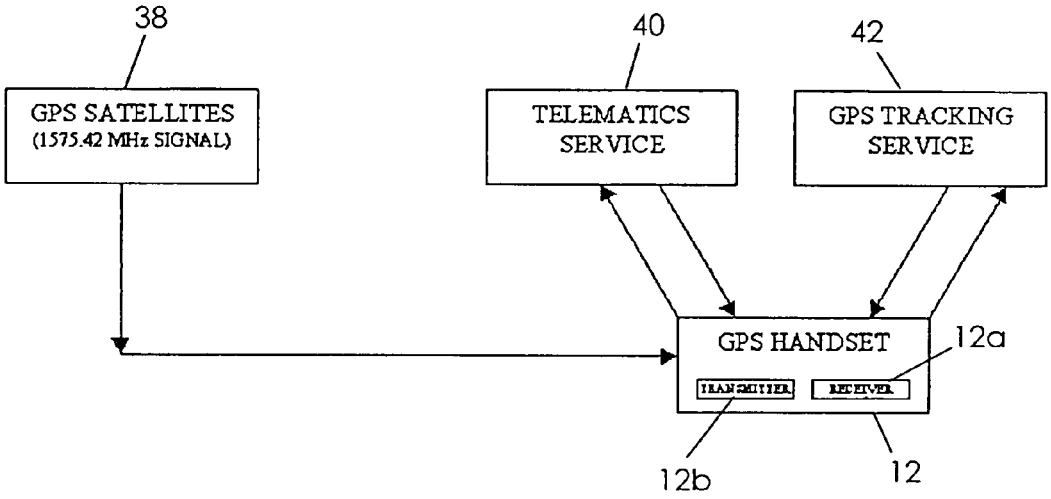
FIG. 6 is a block diagram showing a GPS unit undocked and more than two meters away from the remaining elements of the present invention.

FIGS. 6, 7*a* and 7*b* illustrate the present invention in use. FIG. 6 depicts a control unit 12 not mounted on the mounting member 14 or not within 2–3 meters of the mounting member 14. In this situation and as more fully described above, the control unit 12 receives information from GPS satellites 38 and may then communicate with a telematics service 40 like OnStar or with a GPS tracking service 42 like Trackology.

A control unit 12 mounted in the mounting member 14 is illustrated in FIG. 7*a*. The antenna ring receiver 44 may receive the GPS signals from the GPS satellites 38. The antenna ring transmitter 46, which may be powered from the boat power source 50, and the amplifier 48 may retransmit the GPS signals to the control unit 12. The control unit 12 may then function by communicating with telematics services 40 or GPS tracking services 42. The boat power source 50 may also power the control unit 12 or recharge the battery of the control unit 12.

If the control unit 12 is removed from the mounting member 14, but kept within 2–3 meters thereof, the control unit will still receive the amplified signals from the antenna ring transmitter 46 and amplifier 48. As shown in FIG. 7*b*, where the control unit 12 is not mounted but still within 2–3 meters of the mounting member 14, the control unit 12 may not receive power from the boat power source 50, but may still communicate with telematics services 40 and GPS tracking services 42.

Accordingly, it can be seen that the GPS speedometer and communication device provides the functionality of an advanced GPS speedometer that is conveniently mounted in a boat's dashboard but that also includes a removable control unit for viewing GPS or speed data remote from the dashboard and that includes important safety features needed on nautical vessels.

It is understood that while certain forms of this invention have been illustrated and described, it is not limited thereto except insofar as such limitations are included in the following claims and allowable functional equivalents thereof.

What is claimed is:

1. A speedometer and communications device for use in a boat having a dashboard defining a mounting cavity, said speedometer and communications device comprising:

a mounting member having a flange, said flange having a configuration complementary to a configuration of the mounting cavity for engaging therewith and thereby mounting said mounting member to the dashboard;

an antenna ring situated inside said mounting member, said antenna ring being operatively connected to an antenna ring receiver for receiving GPS signals and an antenna ring transmitter for amplifying and re-transmitting said GPS signals; and a control unit mounted to said mounting member and having a control unit receiver for receiving said retransmitted signals.

2. The speedometer and communications device as in claim 1, further comprising:

a pair of mounting posts extending from a front surface of said mounting member;

said control unit includes a housing having a rear surface defining a pair of mounting slots;

wherein said pair of mounting posts includes a configuration complementary to a configuration of said pair of mounting slots such that said pair of mounting posts are releasably received in said pair of mounting slots in a snap-fit relationship; and said control unit is releasably mounted to said mounting member.

3. The speedometer and communications device as in claim 1, further comprising a fastener having a configuration complementary to a configuration of said flange for selectively receiving said flange and securing said mounting member to the dashboard.

4. The speedometer and communications device as in claim 1, further comprising a fastener threadably coupled to said flange for securing said mounting member to the dashboard.

5. The speedometer and communications device as in claim 1, wherein said control unit includes GPS circuitry for calculating a current global position.

6. The speedometer and communications device as in claim 1, further comprising at least one auxiliary antenna mounted atop a front surface of said mounting member and in electrical connection to said antenna ring for enhancing signal reception by said antenna ring.

7. The speedometer and communications device as in claim 6, wherein said at least one auxiliary antenna is a quad helix antenna for transmitting and receiving signals.

8. The speedometer and communications device as in claim 6, wherein said at least one auxiliary antenna is positioned within a corresponding antenna post that extends beyond said control unit for shielding said control unit from damage when said control unit is mounted to said mounting member.

9. The speedometer and communications device as in claim 1, further comprising:

a power jack situated adjacent a rear surface of said control unit; and a power plug situated atop said mounting member and having a configuration complementary to a configuration of said power jack, said power plug being electrically connected to a boat power source for energizing said control unit when said control unit is mounted to said mounting member.

10. The speedometer and communications device as in claim 9, wherein said control unit includes a rechargeable battery, said rechargeable battery being recharged when said power jack is connected to said power plug.

11. The speedometer and communications device as in claim 1 wherein said control unit includes a control unit transmitter and a button for user-actuation of said control unit transmitter to transmit an emergency signal to a remote telematics or GPS monitoring service.

12. The speedometer and communications device as in claim 1 wherein said control unit includes a housing constructed of a buoyant material.

13. The speedometer and communications device as in claim 1 wherein said control unit includes:

GPS circuitry for calculating a rate of speed of the boat's movement; and a display unit for displaying said rate of speed.

14. A speedometer and communications device for use in a boat having a dashboard defining a mounting cavity, said speedometer and communications device comprising:

a mounting member having a flange, said flange having a configuration complementary to a configuration of the mounting cavity for insertion therein, whereby to mount said mounting member to the boat dashboard;

wherein said mounting member includes a general circular configuration defining an open bottom;

an antenna ring situated in said open bottom of said mounting member, said antenna ring including a receiver for receiving GPS signals and a transmitter for amplifying and re-transmitting said GPS signals; and a hand-held GPS speedometer unit releasably coupled to said mounting member, said GPS speedometer unit having a GPS speedometer receiver for receiving said amplified GPS signals from said antenna ring, and a GPS speedometer unit transmitter for selectively transmitting signals to a remote tracking service.

15. The speedometer and communications device as in claim 14 further comprising a fastener having a configuration complementary to the flange configuration for receiving said flange and securing said mounting member to the dashboard.

16. The speedometer and communications device as in claim 14 wherein said GPS speedometer unit includes a housing constructed of buoyant material.

17. The speedometer and communications device as in claim 14 further comprising an auxiliary antenna mounted to said mounting member for enhancing signal reception by said antenna ring receiver.

18. The speedometer and communications device as in claim 14 further comprising:

an antenna post mounted to a front surface of said mounting member and extending beyond said GPS speedometer unit for protecting said GPS speedometer unit from damage when mounted to said mounting member; and an auxiliary antenna positioned in said antenna post for enhancing signal reception by said antenna ring receiver.

19. The speedometer and communications device as in claim 14 wherein said GPS speedometer unit includes:

means for calculating a rate of speed of the boat using said GPS signals; and a display unit for displaying said rate of speed.

20. The speedometer and communications device as in claim 14 wherein said GPS speedometer unit includes a button for user-actuation of said GPS speedometer transmitter to transmit an emergency signal to a remote telematics or GPS monitoring service.

* * * * *